US006817308B1

(12) United States Patent
Millder

(10) Patent No.: US 6,817,308 B1
(45) Date of Patent: Nov. 16, 2004

(54) SAILING RIG WITH FREESTANDING ROTATING AEROFOIL SECTIONED MAST

(76) Inventor: Randall David Millder, 2830 Potrero Rd., Hidden Valley, CA (US) 91361

( * ) Notice: Subject to any disclaimer, the term of this patent is extended or adjusted under 35 U.S.C. 154(b) by 0 days.

(21) Appl. No.: 10/638,070

(22) Filed: Aug. 8, 2003

(51) Int. Cl.[7] ..... B63B 15/00
(52) U.S. Cl. ..... 114/90; 114/102.1
(58) Field of Search ..... 114/89–94, 102.1, 114/102.13, 102.14, 102.16, 102.29, 39.32, 39.21

(56) References Cited

U.S. PATENT DOCUMENTS 5,176,091 A * 1/1993 Burnham, II ..... 114/39.15
RE35,081 E * 11/1995 Quigley ..... 114/90
5,603,277 A * 2/1997 Webb ..... 114/39.25

* cited by examiner

*Primary Examiner*—Ed Swinehart
(74) *Attorney, Agent, or Firm*—Koda & Androlia

(57) ABSTRACT

A sailing rig including a freestanding, rotating aerofoil sectioned mast. The mast is elliptically curved and rotates about an aft slanted axis and the aerofoil section of the mast is tapered from the mast base to the masthead

10 Claims, 3 Drawing Sheets

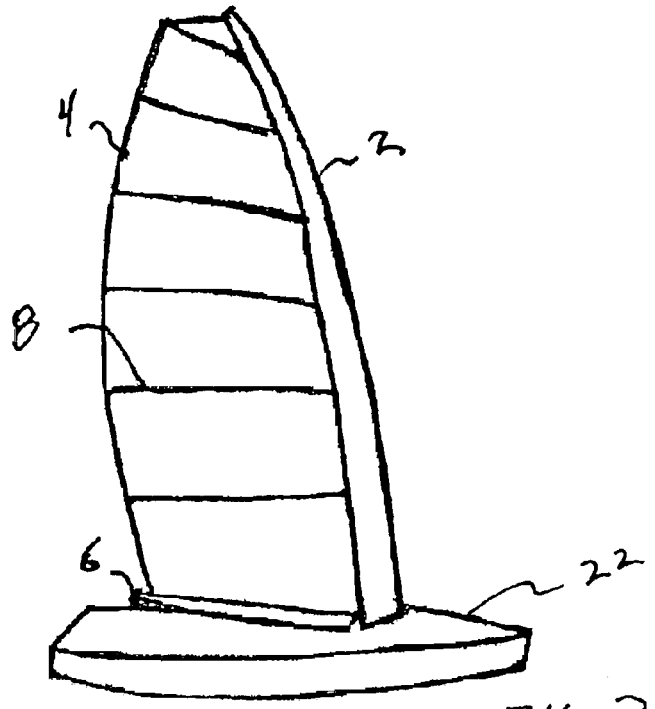
FIG. 2
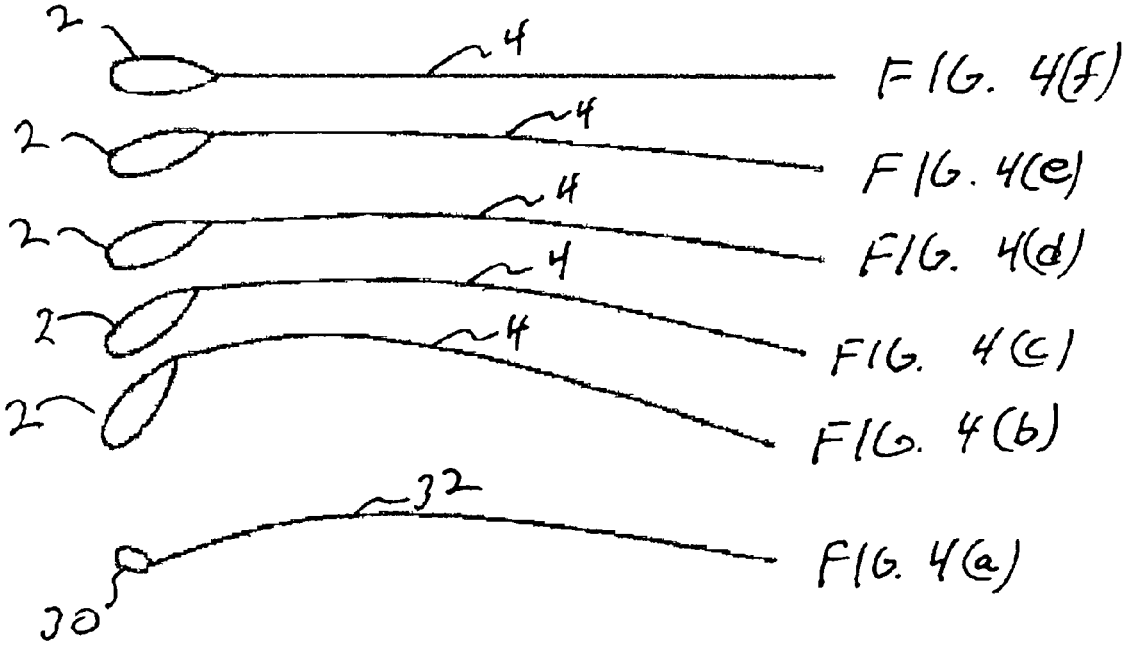

SAILING RIG WITH FREESTANDING ROTATING AEROFOIL SECTIONED MAST

BACKGROUND OF THE INVENTION

1. Field of Invention

This invention relates to sailing rigs and particularly to masts for sailing rigs.

2. Prior Art

Sailing rigs have existed for thousands of years. A typical sailing rig includes an essentially oval in cross-section fixed mast which is held in place by a plurality of stays, tumbuckles and shackles. The mast supports the sail and along with the boom creates driving force to cause a watercraft to be propelled across water. However, such a traditional mast for sailboats act as an obstacle to the airflow and are not aerodynamic. Accordingly, they result in high drag and the efficiency of the sailing rig is generally reduced.

To overcome these problems of the traditional mast, rotating wing masts or unarigs have been provided. Such rotating wing masts or unarigs are aerodynamic and improve the efficiency of the sailing rig. However, such rotating wing mast or unarigs are placed well forward in the sail powered craft and as a result prevent the utilization of a spinnaker.

While both the traditional and rotating wing mast have existed for a long time, both have one or more significant shortcomings. In particular, they have a high center of gravity which contributes to the instability and the tendency to turn over or pitch of the sailing craft in high winds, particularly monohulls. Still further, the utilization of a plurality of stays, tumbuckles and shackles provides a plurality of additional failure points in the sailing rig and thereby reduces the reliability. Additionally, such sails have one or more of the disadvantages as follows: a narrow fully powered range, have inadequate camber control of the sail and generally require the utilization of additional storm sail.

SUMMARY OF THE INVENTION

Accordingly, it is a general object of the present invention to overcome the disadvantages of the prior art.

In particular, it is an object of the present invention to provide a mast which is aerodynamic, low in drag, high in efficiency, a low center of gravity, a wide fully powered range, good camber control of the sail, high reliability and moderate leech.

Still further, it is the object of the present invention to provide a sailing rig with a mast which can be utilized together with a spinnaker and does not require a storm sail.

In keeping with the objects of the present invention, the present invention provides a sailing rig including a freestanding rotating aerofoil sectioned mast. The aerofoil sectioned mast is elliptically curved from the mast base to the masthead and is rotatable about an aft slanted axis which aligns the mast base and the masthead such that the masthead does not fall off to leeward when the mast rotates. Still further, the aerofoil sectioned mast is tapered in aerofoil section from the mast base to the masthead to reduce the weight of the aerofoil sectioned mast toward the masthead to thereby reduce the center of gravity. Moreover, the aerofoil sectioned mast is formed such that the thickness of the walls of the aerofoil section from the mast base to the masthead is reduced to achieve more flexibility and further reduce the weight at the masthead.

BRIEF DESCRIPTION OF THE DRAWINGS

The above-mentioned features and objects of the present invention will become more apparent with reference to the following description taken in conjunction with the accompanying drawings wherein like reference numerals denote like elements and in which:

FIG. 2 is a simplified view of a sailboat with the present invention mounted thereto;

FIG. 4(*a*) illustrates a conventional mast and sail while FIGS. 4(*b*)–4(*f*) illustrate the mast and sail of the present invention wherein the mast is rotated to various positions.

DETAILED DESCRIPTION OF THE INVENTION

Figure 1:
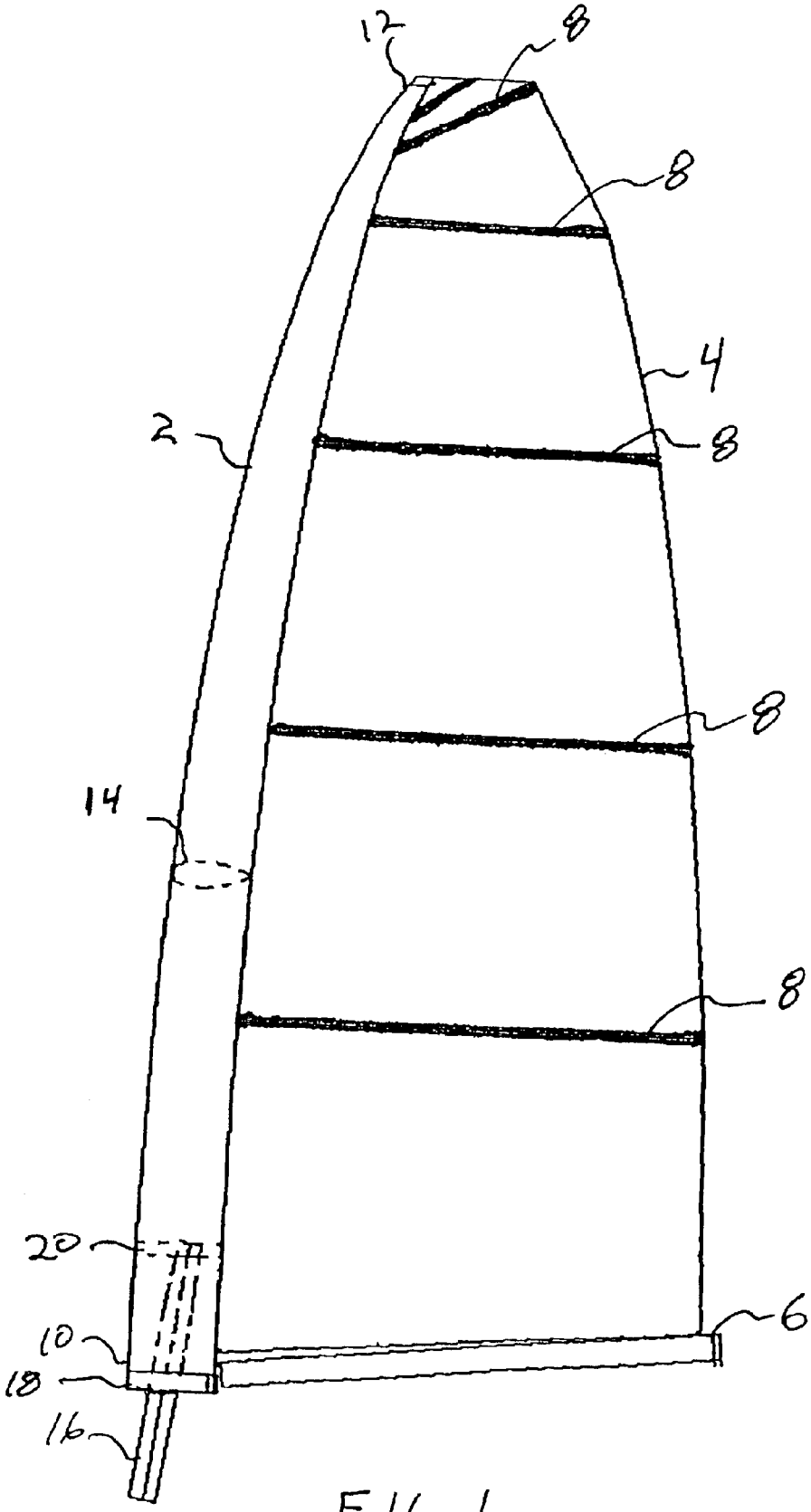
FIG. 1 is a view of a sailing rig in accordance with the teachings of the present invention and particularly the freestanding rotating aerofoil sectioned mast of the present invention.

Referring to FIG. 1, shown therein is the basic sailing rig of the present invention. The sailing rig essentially comprises a mast 2, sail 4 and boom 6. The boom 6 is pivotally coupled at its fore end to the mast 2 and the lower aft corner of the sail 4 is connected to the aft end of the boom 6. The sail 4 is further coupled along its fore edge to the mast 2. Preferably, the sail 4 is a squared top, fully battened, absolutely flat sail with no built-in draft. Accordingly, it includes battens 8.

The mast 2 is a freestanding, rotating, aerofoil sectioned mast. In particular, the mast 2 is elliptically curved from the base 10 to the head 12 and has an aerofoil cross-section 14 as is shown in dotted lines in FIG. 1. The mast 2 is further tapered in cross-section from the base 10 to the head 12 in a range of 60–80%, preferably 70–75%. The mast chord length of the mast 2 makes up substantially 15% of the mast and sail aerofoil and the mast 2 has a thickness to chord ratio of substantially 33%. The mast 2 can be made up of any material such as metals, resins, metal resin composites, resin composites, etc. Preferably, the mast 2 has a wall thickness which tapers from the base 10 to the head 12 and is preferably constructed out of high strength carbon fiber in an epoxy matrix which is preferably vacuumed bagged over a foam core. The carbon skin of the carbon fiber in the epoxy matrix preferably tapers from the base to the tip and consists of 70% unidirectional fibers along the axis of the mast 2, 20% set in the ±45° direction and 10% in a hoop direction around the circumference of the aerofoil shape 14.

The mast 2 is further provided with a rotational support tube 16 which is coupled to the lower portion of the mast 2 at an aft angle and supported by upper and lower supports 18 and 20. The lower support 18 further provides a bearing surface for the rotational mast 2. Alternately, the support tube 16 could be made integrally with the mast 2.

As is clear from FIG. 2, the sailing rig is provided on the sailboat hull 22 such that the mast 2 is freestanding and is not held up by any stays, tumbuckles and/or shackles.

Figure 3:
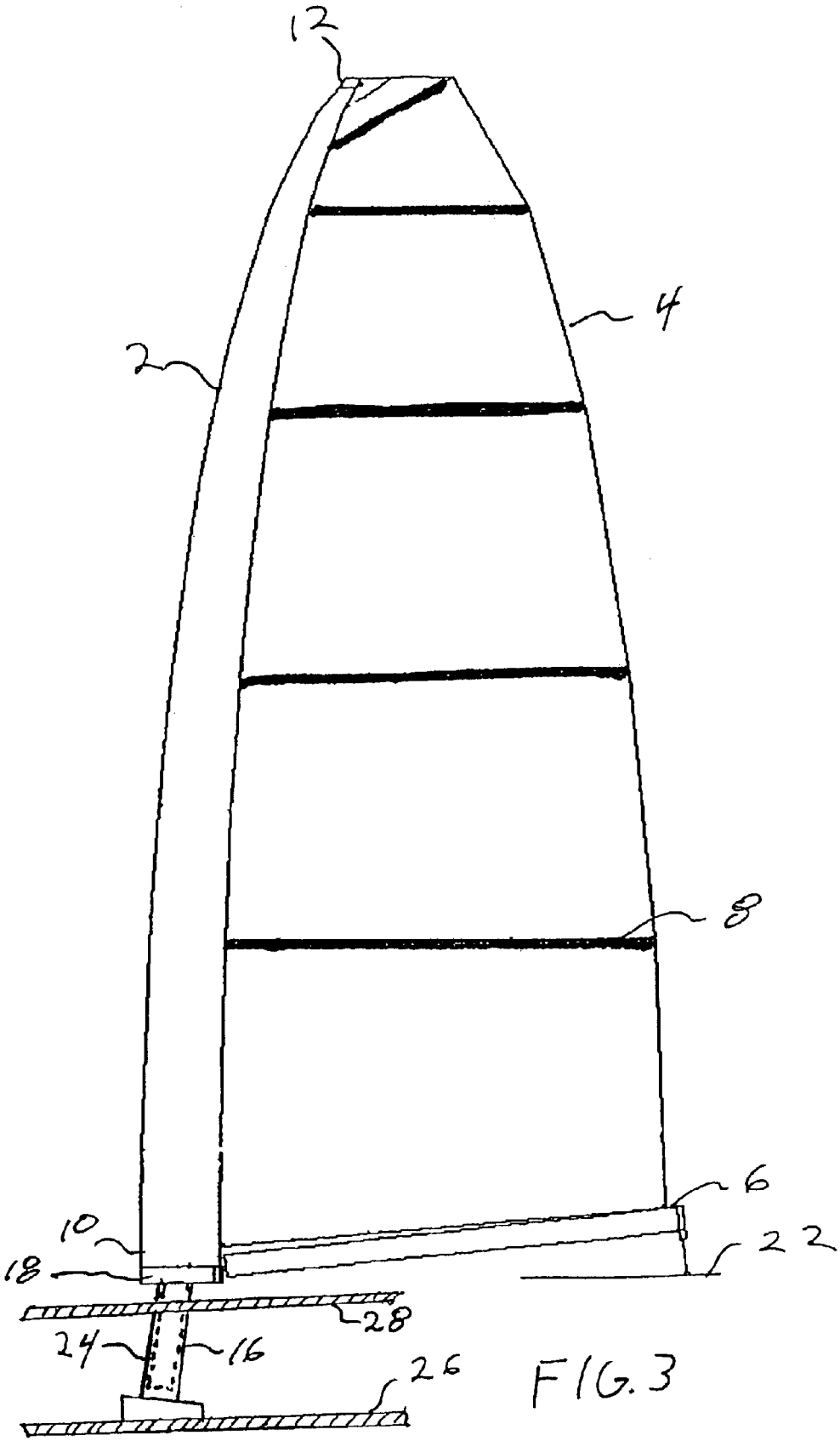
FIG. 3 is a partial cross-section of the sailboat of FIG. 2 showing the mounting of the sailing rig of the present invention.

As is shown in FIG. 3, the tube 16 of the mast 2 is rotatably inserted into a mast support tube 24 which is angled aft and is supported at its bottom by the bottom of the hull 26 of the sailboat 22 and at its top portion by the deck 28 of the sailboat hull 22. In addition, the top end of the tube 24 has the lower support 18 acting as a bearing riding on the top surface of the tube 24. In this way, the sailing rig including the mast 2, sail 4 and boom 6 can rotate freely about an aft inclined axis. The angle of this aft inclined axis is selected so that the axis of rotation of the mast 2 aligns the mast base 10 and the head 12 so that the masthead 12 does not fall off to leeward when the mast 2 rotates. Typically, this aft angle is in the range of 5–10° and preferably about 7°.

Referring to FIGS. 4(*a*)–4(*f*), shown therein is a comparison of the operation of the sailing rig of the present invention, FIGS. 4(*b*)–4(*f*), and the prior art, FIG. 4(*a*). In particular, in FIG. 4(*a*), it can be seen that the traditional mast 30 is of constant cross sectional shape does not rotate with the sail 32 and is not of any aerodynamic shape. As a result, the traditional mast 30 and sail 32 shown in FIG. 4(*a*) presents an obstacle to the airflow and creates a lift sapping and drag creating disturbance. In contrast thereto and is shown in FIGS. 4(*b*)–4(*f*) as the direction of the wind changes and the mast 2 rotates, the mast 2 together with the sail 4 provide a continuous aerodynamic profile that increases the lift and reduces the drag. As a result, the sailing rig of the present invention provides better sailing efficiency and better utilization of the energy stored in the wind.

In addition to the above described advantage of the present invention over the prior art, the elliptical curvature and aft tilted rotational axis of the mast 2 of the present work in concert with the flat fully batten sail 4 to provide excellent camber control. In particular, as the mast 2 rotates, the leading edge of the sail 4 is brought closer to an imagery thread line between the head and the clew of the sail 4 which induces camber into the sail 4 and high rotation of the mast 2 creates a highly cambered sail that generates excellent lift and moderate drag as is shown in FIG. 4(*b*). Still further, reducing the rotation of the mast 2 flattens the sail and reduces both the lift and drag for going into high wind, as is shown in FIG. 4(*f*). This adjustability as is shown in FIGS. 4(*b*)–4(*f*) keeps sailboats fully powered over a broad range of wind conditions.

In addition to the above described advantages of the sailing rig of the present invention, there are still further advantages in the fact that the sailing rig is more reliable than traditional sailing rigs because it does not require a plurality of stays, tumbuckles and/or shackles, can be utilized with a spinnaker without difficulty because the mast 2 is placed roughly at the same location on the sailing boat hull 22 as a traditional mast, has reduced pitching moments because the tapered mast and tapered cross-section reduce the center of gravity of the mast 2 and does not require a storm sail because in heavy winds the sailing rig can be sailed with only the mast 2 while still providing sufficient motive power for the sailboat.

It should be apparent to those skilled in the art that the above-described embodiment is merely illustrative of one embodiment of the present invention and numerous and other variations could be created without departing from the spirit and scope of the invention.

What is claimed is:

1. A sailing rig comprising a freestanding rotating aerofoil sectioned mast wherein:

said mast is elliptically curved from a mast base to a masthead;

said mast is rotatable about an aft slanted axis;

said aft slanted axis aligns said mast base and head such that said masthead does not fall off to leeward when said mast rotates; and said mast is tapered in aerofoil cross-section from said mast base to said masthead.

2. The sailing rig according to claim 1, wherein said mast is made from a material selected from the group consisting of metals, resins, metal resin composites and resin composites.

3. The sailing rig according to claim 2, wherein the resin composite is a carbon fiber in an epoxy matrix.

4. The sailing rig according to claim 3, wherein a thickness of said carbon fiber in an epoxy matrix tapers from the mast base to the masthead.

5. The sailing rig according to claim 1, wherein the mast is heavier adjacent the mast base than adjacent the masthead.

6. The sailing rig according to claim 1 further comprising a square topped fully battened flat sail with no built-in draft.

7. The sailing rig according to claim 3, wherein the carbon fiber in an epoxy matrix is vacuum bagged over a foam core.

8. The sailing rig according to claim 7, wherein a thickness of said carbon fiber in an epoxy matrix tapers from the mast base to the masthead.

9. The sailing rig according to claim 7, wherein a thickness of said carbon fiber in an epoxy matrix varies from a mast base to a masthead.

10. The sailing rig according to claim 1, wherein said mast is made from a material selected from the group consisting of metal, resins, metal resin composites and resin composites.

* * * * *

UNITED STATES PATENT AND TRADEMARK OFFICE

CERTIFICATE OF CORRECTION

PATENT NO. : 6,817,308 B1
APPLICATION NO. : 10/638070
DATED : November 16, 2004
INVENTOR(S) : Randall David Miller It is certified that error appears in the above-identified patent and that said Letters Patent is hereby corrected as shown below:

Item (76) Inventor:

Change "Randall David Millder, 2830 Potrero Rd., Hidden Valley, CA (US) 91361" to --Randall David Miller, 2830 Potrero Rd., Hidden Valley, CA (US) 91361--

Signed and Sealed this

Twenty-first Day of October, 2008

JON W. DUDAS
*Director of the United States Patent and Trademark Office*